US010610456B2

(12) United States Patent
Gosselin et al.

(10) Patent No.: US 10,610,456 B2
(45) Date of Patent: Apr. 7, 2020

(54) CHILD-RESISTANT DOSING CAP

(71) Applicant: RedCap LLC, Marblehead, MA (US)

(72) Inventors: Daniel Albert Gosselin, Gloucester, MA (US); Alfred Richard Balakier, Kirkland, WA (US)

(73) Assignee: Recap LLC, Marblehead, MA (US)

( * ) Notice: Subject to any disclaimer, the term of this patent is extended or adjusted under 35 U.S.C. 154(b) by 0 days.

(21) Appl. No.: 15/974,438

(22) Filed: May 8, 2018

(65) Prior Publication Data

US 2018/0318174 A1 Nov. 8, 2018

Related U.S. Application Data

(60) Provisional application No. 62/503,099, filed on May 8, 2017.

(51) Int. Cl.

| | |
|---|---|
| ***A61J 7/04*** | (2006.01) |
| ***B65D 50/04*** | (2006.01) |
| ***A61J 1/03*** | (2006.01) |
| ***A61J 1/14*** | (2006.01) |
| ***A61J 7/00*** | (2006.01) |
| ***B65D 83/04*** | (2006.01) |

(52) U.S. Cl.

CPC . *A61J 7/04* (2013.01); *A61J 1/03* (2013.01); *A61J 1/1418* (2015.05); *A61J 7/0076* (2013.01); *B65D 50/04* (2013.01); *B65D 50/041* (2013.01); *B65D 83/04* (2013.01); *B65D 2215/02* (2013.01); *B65D 2583/0409* (2013.01); *B65D 2583/0472* (2013.01); *B65D 2585/56* (2013.01)

(58) Field of Classification Search

CPC .... A61J 7/04; A61J 1/03; B65D 50/04; B65D 83/04; B65D 2585/56; B65D 2583/0472; B65D 2215/02; B65D 2583/0409

USPC ..... 206/528, 530, 534, 533, 540, 459.5

See application file for complete search history.

(56) References Cited

U.S. PATENT DOCUMENTS

| | | | | | |
|---|---|---|---|---|---|
| 3,151,599 | A | * | 10/1964 | Livingston | A61J 7/04 116/308 |
| 4,011,829 | A | * | 3/1977 | Wachsmann | A61J 7/04 116/308 |
| 4,365,722 | A | * | 12/1982 | Kramer | A61J 7/04 116/308 |

(Continued)

*Primary Examiner* — Jacob K Ackun
*Assistant Examiner* — Jenine Pagan
(74) *Attorney, Agent, or Firm* — Olympic Patent Works PLLC

(57) ABSTRACT

The current disclosure is directed to a container with a dispensing schedule and, in various described implementations, to a container and a complementary cap that includes a dispensing schedule. During each dispensing cycle, which includes removing the cap from the container to allow access to the contents of the container and re-securing the cap to the container, the display schedule is automatically advanced to a next indication. In one implementation, the container is a bottle with a threaded neck and the cap is complementarily threaded and has a cylindrical rim and a schedule display. An indication on or within the schedule display is displayed through an aperture in the cap rim. Features included in the cap and the schedule display interoperate to ensure that the displayed indication is advanced to a next indication when the cap is unscrewed from, and subsequently threaded onto, the bottle.

19 Claims, 6 Drawing Sheets

(56) References Cited

U.S. PATENT DOCUMENTS

| | | | | | |
|---|---|---|---|---|---|
| 4,749,093 | A * | 6/1988 | Trick | B65D 41/06 | 116/308 |
| 5,115,929 | A * | 5/1992 | Buono | B65D 50/041 | 215/216 |
| 5,188,251 | A * | 2/1993 | Kusz | A61J 7/04 | 116/308 |
| 5,577,335 | A * | 11/1996 | Tucker | A47B 23/044 | 116/309 |
| 9,132,945 | B1 * | 9/2015 | Midboe | B65D 50/02 | |
| 2014/0202978 | A1 * | 7/2014 | Hwang, II | A61J 7/04 | 215/230 |
| 2014/0374301 | A1 * | 12/2014 | West | G09F 11/04 | 206/459.5 |

* cited by examiner

CHILD-RESISTANT DOSING CAP

CROSS-REFERENCE TO RELATED APPLICATION

This application claims the benefit of Provisional Application No. 62/503,099 filed May 8, 2017.

TECHNICAL FIELD

The current disclosure is related to various types of containers, including pill bottles, and, in particular, to a container with a dispensing schedule that indicates when the contents within the container should next be accessed.

BACKGROUND

Failure to adhere to a prescribed medication-dosage regimen is a dangerous and ubiquitous problem. Missing a prescribed dosage of certain medications, such as blood-pressure medicine, may result in significant harm and even death. Accidental overdose of prescription medication often causes negative effects that are even more dangerous and immediate than missing a prescribed dosage.

According to the National Council on Patient Information, up to 60% of all prescribed medication is taken incorrectly. Physicians take only 75% of prescribed pills correctly. Non-compliance costs more than $300 billion a year in the USA, accounts for 13% of all hospital admissions, and causes 150,000 deaths.

In addition to prescribed medication, there are vitamins and other supplements that do not require a prescription from a doctor and that are also recommended for use according to a regular schedule. Failure to adhere to a recommended schedule may lessen the effectiveness of the vitamins and other supplements and may exposes a consumer to the risk of overdose. Pills prescribed by veterinarians for the care of animals are associated with similar risks and consequences when not used according to a prescribed dosing schedule.

Many different medicine dispensers and medicine-dispensing regimes have been proposed and developed in order to assist consumers in self-administration of drugs, vitamins, and other consumables. However, the fact that, according to current statistics, non-compliance with administration schedules continues to be a serious problem and represents a significant financial burden to consumers as well as to society, as a whole, indicates that the many proposed and currently-available regimes and dispensers have not effectively addressed problems associated with self-administration of pills by consumers.

Many pills are currently distributed in threaded bottles. Most often, these threaded bottles are blow-molded. Unlike injection molded bottles, a blow-molded bottle can be readily manufactured to have a neck portion smaller in diameter than the diameter of the main portion of the bottle. Blow-molded bottles can be manufactured to have different volumes, shapes, and sizes that share a commonly sized neck and thus a commonly sized cap. Blow-molded, threaded bottles are mass-produced at low cost. A significant portion of existing manufacturing facilities and automated dispensing systems are configured to produce and use threaded bottles.

SUMMARY

The current disclosure is directed to a container with a dispensing schedule and, in various described implementations, to a container and a complementary child-resistant cap that includes a dispensing schedule. During each dispensing cycle, which includes removing the cap from the container to allow access to the contents of the container and re-securing the cap to the container, the display schedule is automatically advanced to a next indication. In one implementation, the container is a bottle with a threaded neck and the cap assembly is complementarily threaded and has a cylindrical rim and a schedule display. An indication on or within the schedule display is displayed through an aperture in the cap rim. Features included in the cap and the schedule display interoperate to ensure that the displayed indication is advanced to a next indication when the cap is unscrewed from, and subsequently threaded onto, the bottle.

DETAILED DESCRIPTION

Figure 1:
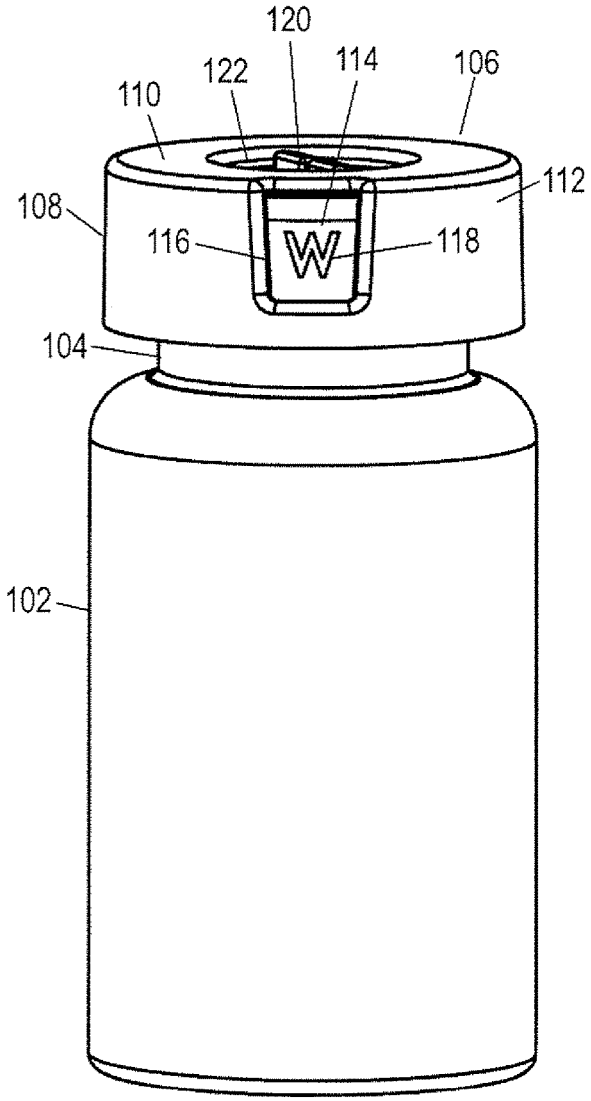
FIG. 1 shows a perspective view of one implementation of the child-resistant dosing cap ("CRDC") to which the current disclosure is directed.

FIG. 1 shows a perspective view of one implementation of the container with a dispensing schedule to which the current disclosure is directed. The illustrated implementation of the container with a dispensing schedule ("CRDC") includes a bottle 102 with a threaded neck 104 (threads obscured by cap in FIG. 1) and a complementarily threaded cap assembly 106. Cap assembly 106 includes a cap 108 with a disk-shaped top 110 and skirt 112 and that also includes a schedule-display 114 visible through cap aperture 116. A single indication 118, printed, attached, or otherwise included on or within the schedule display, is aligned with the cap aperture 116 and is therefore visible through the cap aperture from viewpoints external to the CRDC. In the example CRDC implementation shown in FIG. 1, the displayed indication 118, "W," indicates that a next dose is scheduled for administration on Wednesday. The schedule-display also includes grips 120 visible through hole 122 on the top surface of cap 108.

Interior features of the cap and schedule display interoperate with one another and with bottle features to ensure that the displayed indication is correctly advanced to a next indication within a circular sequence of schedule-display indications when the cap is unscrewed and removed from the bottle and then screwed back on the bottle. Unscrewing and removing the cap from the bottle followed by screwing the cap back onto the bottle constitutes a single dispensing cycle. The displayed indication is not advanced unless either the cap is successfully removed and replaced or the displayed indication is deliberately and manually advanced using manual-advancement features, discussed below. Interior features of the cap and schedule-display provide a means of child-resistance to diminish accessibility to the contents of the bottle by children.

The size and location of the cap aperture provides visibility to a surface area of the schedule display that is of sufficient size and that is properly oriented to provide a clear and easily read indication. In alternative CRDC implementations, indications may be displayed parallel to the top of the cap. The schedule-display indications may vary with different CRDC implementations and may include an essentially arbitrary number of different indications. The indication may, for example, indicate a portion of a day, such as "am" or "pm," may display a particular hour, such as "9," may display a day of the week, such as "W" or "Th," and may display any combination of one or more of a portion of a day, a particular hour, and a day of the week. In other CRDC implementations, schedule indications may indicate precise date and/or time information. In the example CRDC implementation shown in FIG. 1, the schedule display includes fourteen different indications, sufficient for two doses for each day of the week, for example, Tu AM/Tu PM. As shown in Figure one, there are indications for one dose for each day of a week, arranged in two contiguous and continuous circular sequences.

The cap assembly of the CRDC implementation shown in FIG. 1 has three single-piece components. This relatively small number of components is efficiently and cost-effectively mass produced and assembled from common polymeric materials, including polypropylene and polyethylene terephthalate ("PET"). When manufactured with currently-available precision, interoperating components in the cap assembly provide for child-resistance and reliable advancement of the displayed indication by a single indication within the circular sequence of schedule-display indications during each dispensing cycle. CRDC implementations are designed for rapid, reliable, and cost-efficient manufacturing. A single-piece component is a component that can be directly manufactured, without subsequent assembly from multiple subcomponents, such as a plastic object that is injection molded and a metal object that is cut, stamped, and/or shaped from a single continuous metal sheet or block. Each additional component within an assembly or subassembly adds time, cost, and complexity to the manufacturing process, which is why the above-discussed number-of-components constraint is significant.

The indication-advancement mechanism in the cap assembly is designed to function effectively with common threaded bottles that have relatively shallow thread pitches. The mechanism is robust and versatile, and is easily scaled to accommodate threaded bottles with various different neck sizes and thread designs, including threaded bottles currently used for storing medicines, vitamins, and other supplements. The mechanism is designed so that it does not stress the various components. When the cap assembly is affixed to the bottle the components are in a resting position without tension from stretching, flexing, or compression in the components which could cause distortion over time.

The CRDC implementation shown in FIG. 1 is compatible with foil seals, both induction-heat adhered and glued, that are used for tamper-resistant packaging and for isolating the interior of the bottle from the external environment. The disclosed CRDC implementation is also designed to be compatible with resealable seals as well as to accommodate paper and wax seals. The inclusion of additional seals is optional because the cap provides and airtight, moisture impermeable seal. The currently disclosed CRDC implementation also provides an aesthetically pleasing click or other notification of successful indication advancement, including haptic feedback. The currently disclosed CRDC implementation incorporates single-threaded or multi-threaded bottles, including threadings with pitches of less than 2.5 degrees, less than 5 degrees, between 1.5 and 2 degrees, between 2.0 and 2.5 degrees, between 2.5 and 3 degrees, between 3 and 4 degrees, and between 4 and 5 degrees. The currently disclosed CRDC implementation maintains accurate indication advancement over an arbitrary number of dispensing cycles and manual advancements, since indication advancement is precise and robust.

Figure 2:
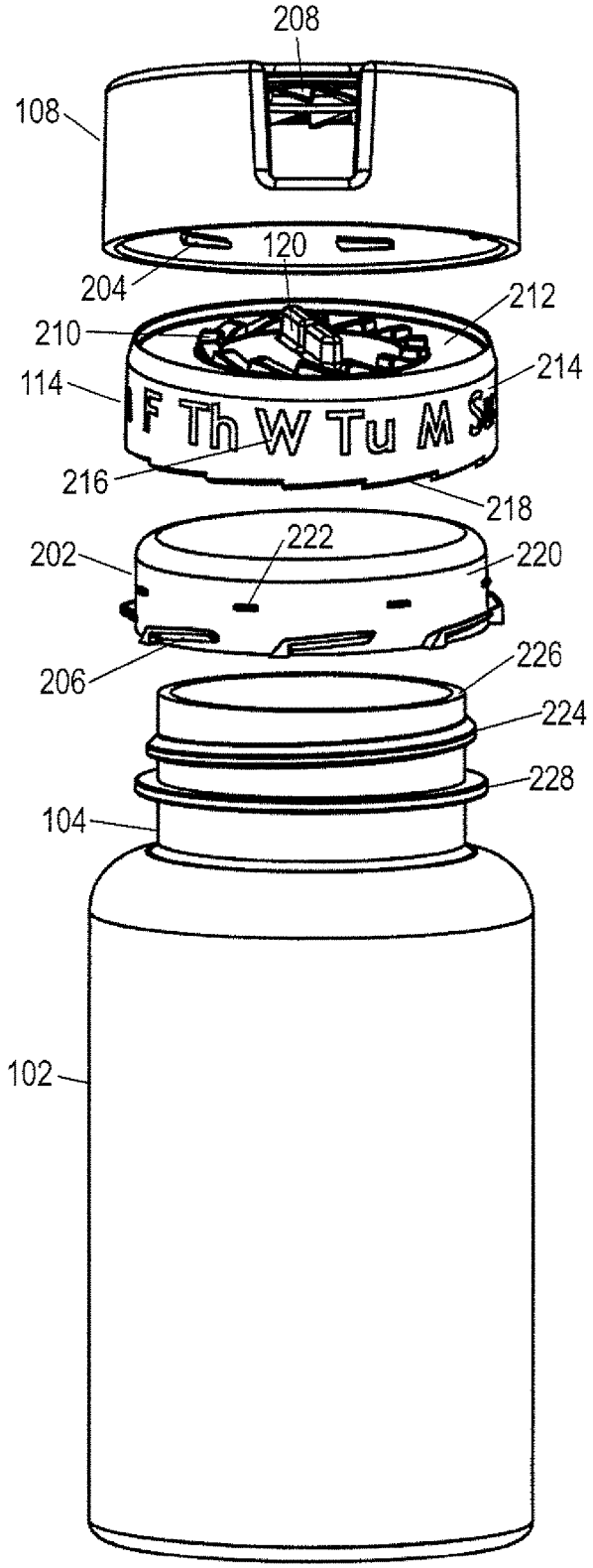
FIG. 2 shows an exploded perspective of the CRDC implementation shown in FIG. 1.

FIG. 2 shows an exploded perspective of the CRDC implementation shown in FIG. 1. In the exploded view, the two components of the cap assembly shown in FIG. 1 are visible, as is an additional cap assembly component, inner cap 202. FIG. 2 also shows additional features of the three cap assembly components and bottle. The cap 108 is shown removed from, and above, the schedule display 114. The cap 108 has an internal lugs, including lug 204, complementary to bosses around the outside of the inner cap, such as boss 206. Teeth, including tooth 208, on the interior surface of the top of the cap together comprise a first ratchet wheel, the teeth of the first ratchet wheel engaging with teeth of a second ratchet wheel, including tooth 210, on an upper surface 212 of the schedule display.

Fourteen schedule indications are printed on, affixed to, or incorporated within the inclined, external surface 214 of the schedule display 114, including indication "W" 216. In addition, the schedule display 114 includes fourteen biasing features around the bottom of the side wall, including biasing feature 218, which interact with inner cap bosses 206 in the indicating process.

Inner cap 202 further includes side wall 220 around which are seven protrusions, such as protrusion 222, which help affix it inside of the schedule display. The inner cap also includes a thread (not visible in FIG. 2) compatible with external threading 224 on the neck 104 of the bottle 102, allowing the cap to be screwed downward to close the bottle and to be unscrewed upward to open the bottle. A sealing surface on the underneath of the inner cap, which is not visible in FIG. 2, provides an airtight, gasket-like seal between the bottle and the cap assembly when the cap assembly is screwed onto the bottle. The bottle 102 also includes a lip 226 and a stop annulus 228.

Figure 3:
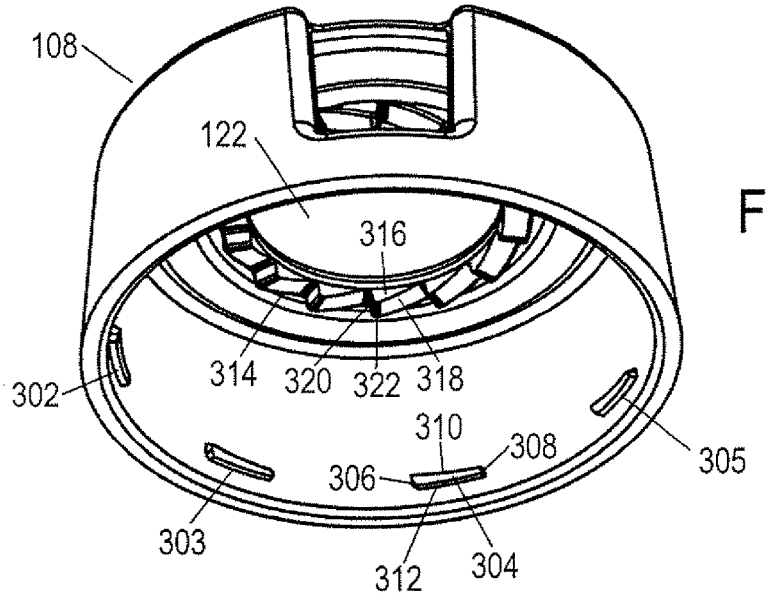
FIG. 3 shows a perspective view from below of the cap shown in FIG. 1.

FIG. 3 shows a perspective view from below of the cap shown in FIG. 1. FIG. 3, four of seven cap lugs 302-305, each including a tapered end 306, a blunt end 308, an upper sliding surface 310, and lower sliding surface 312. Cap ratchet wheel 314 is visible around hole 122. Each ratchet wheel tooth, like tooth 316, further includes a sliding side 318, an engaging side 320, and a tip 322.

Figure 4A:
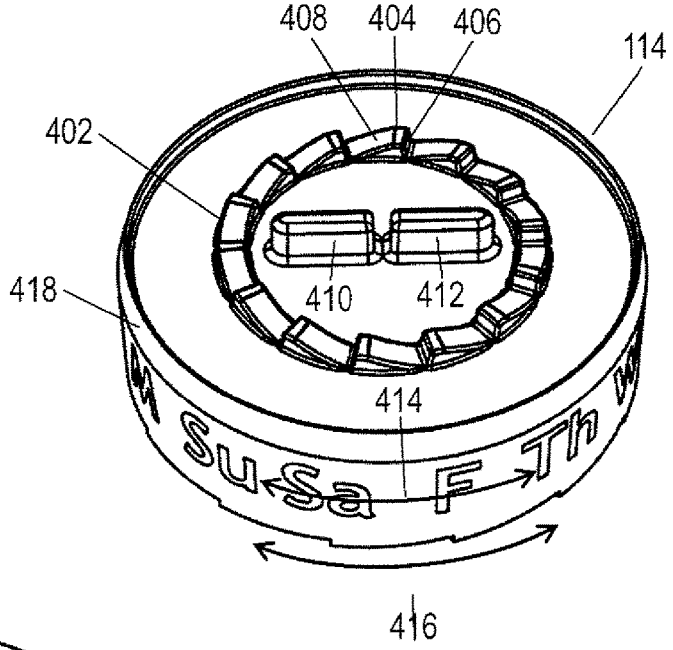
FIGS. 4A-B show alternative views of the schedule-display shown in FIG. 1.
Figure 4B:
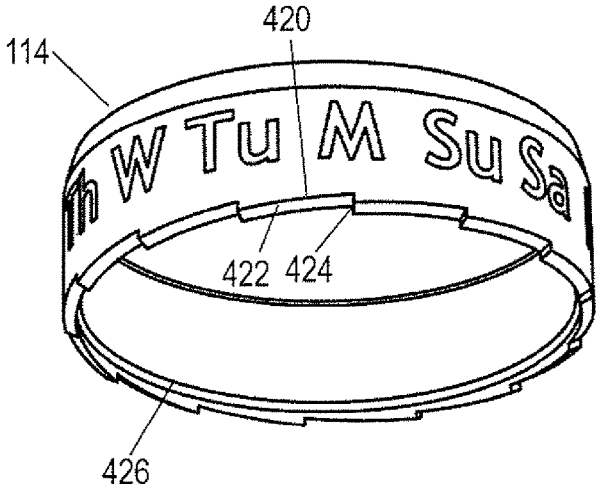

FIGS. 4A-B show alternative views of the schedule-display 114. FIG. 4A shows a perspective view of the schedule display from the top and 4B shows a perspective view of the schedule display from the bottom. As shown in FIG. 4A, ratchet wheel 402 comprises teeth, such as tooth 404, further comprised of an engaging side 406 and a sliding side 408. Schedule display 114 further includes grips 410 and 412. Schedule display 114 also further comprises a series of 14 indicia 414 and biasing features 416. Annular taper 418 aids in insertion of the schedule display into the cap for assembly. As shown in FIG. 4B each of the biasing features, such as biasing feature 420, is further comprised of a sliding surface 422 and engaging side 424. Schedule display biasing features may be one or more ratchet teeth like extensions, as shown in FIG. 4B, as well as a variety of protrusions or indentations that can complementarily interoperate with the cap lugs and inner cap bosses to prevent the schedule display from rotating around the inner cap when the cap assembly is affixed. The biasing features may be located around the base of the sidewall of the schedule display as shown, or around the outer or inner perimeter of the sidewall. Annular retainer 426 around the inside of the schedule display keeps inner cap 202 rotatably mounted within the schedule display via the inner cap protrusions (520-522 in FIG. 5) once inserted.

Figure 5:
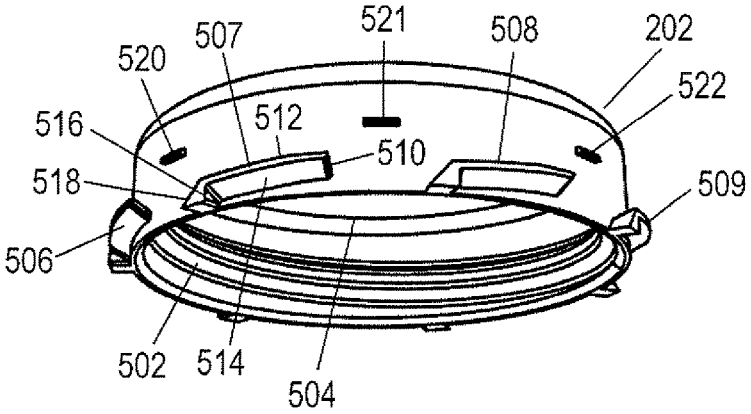
FIG. 5 shows a perspective view from below of the inner-cap shown in FIG. 2.

As shown in FIG. 5, inner cap 202 comprises internal thread, 502 and sealing surface 504. Sealing surface 504 is designed for interaction with a foil or paper seal. When bottles are on a filling line, a seal placed into the cap assembly rests on the sealing surface 504. The cap is then positioned on the bottle so that the seal comes into contact with the lip 226 of the bottle. In the case of an induction-adhered seal, an electric current in a nearby coil causes the metallic foil to heat and adhere to the rim of the bottle. In other cases, an adhesive or wax sealant may be used.

Inner cap 202 further comprises of seven bosses, including 506-509, which, as described further within, facilitate both indicating and child-resistance. Each boss, such as boss 507, is further comprises of a leading edge 510, upper sliding surface 512, lower sliding surface 514, stop portion 516, and sliding end 518. Inner cap bosses may be one or more bayonet mount like features, as shown in FIG. 5, as well as a variety of protrusions or indentations that can complementarily interoperate with the cap lugs and biasing features to prevent the schedule display from rotating around the inner cap when the cap assembly is affixed. Inner cap 202 further comprises protrusions, including 520-522 around its side wall for mounting inside of the schedule-display which, in combination with retainer 426 (see FIG. 4B) keep the inner cap mounted within the schedule display.

Figure 6:
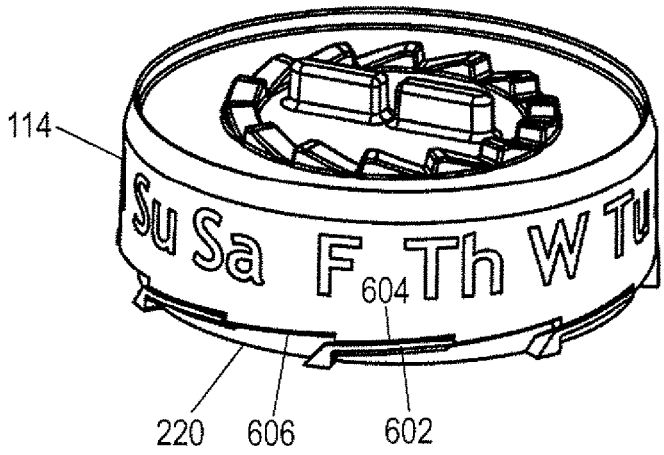
FIG. 6 shows a perspective view of the inner-cap shown in FIG. 2 affixed inside the schedule-display shown in FIGS. 1-2.

FIG. 6 shows a perspective view of the inner cap 220 shown in FIG. 2 affixed inside the schedule display 114 shown in FIG. 2. Inner cap bosses are settled into settled into schedule display biasing features, for example, boss 602 is settled into biasing feature 604. Since there are fourteen schedule display biasing features and seven inner cap bosses, every other biasing feature, like feature 606 is not resting over an inner cap boss.

Figure 7:
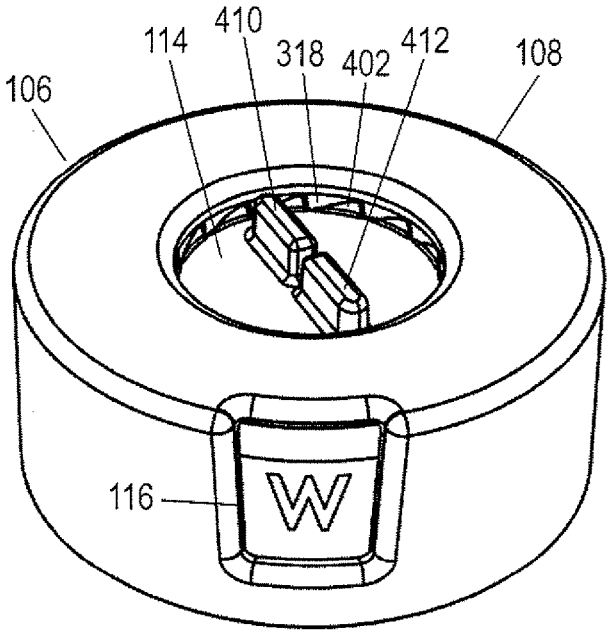
FIG. 7 shows a perspective view from above of the cap assembly shown in FIG. 1.

FIG. 7 shows a perspective view from above of the cap assembly shown in FIG. 1. The inner cap assembly shown in FIG. 6 is inserted into cap 108. When schedule display 114 is inserted into outer cap 108, the teeth of ratchet wheels 314 and 402 fully mesh to center the display aperture 116 over an indication. Grips 410 and 412 are visible and accessible through the hole 122 in the cap, which can be used to manually rotate the schedule display until a desired starting indication is visible below cap aperture 116 for administrating the first dose. The grips may be one or more raised tabs as well as a variety of protrusions, indentations, or holes that can provide a similar schedule-display-positioning function in alternative CRDC implementations. These features can either be part of, or connected to, the upper disk-shaped surface of the schedule display, or be positioned for access under the inner cap. The meshing of cap ratchet wheel (314 in FIG. 3) and schedule display ratchet wheel (402 in FIG. 4A) prevents the schedule display from freely rotating within the cap, but allows the schedule display to be manually rotated, by applying a rotational force to the grips 410-412 in order to select a particular schedule indication for display through the cap aperture.

Figure 8:
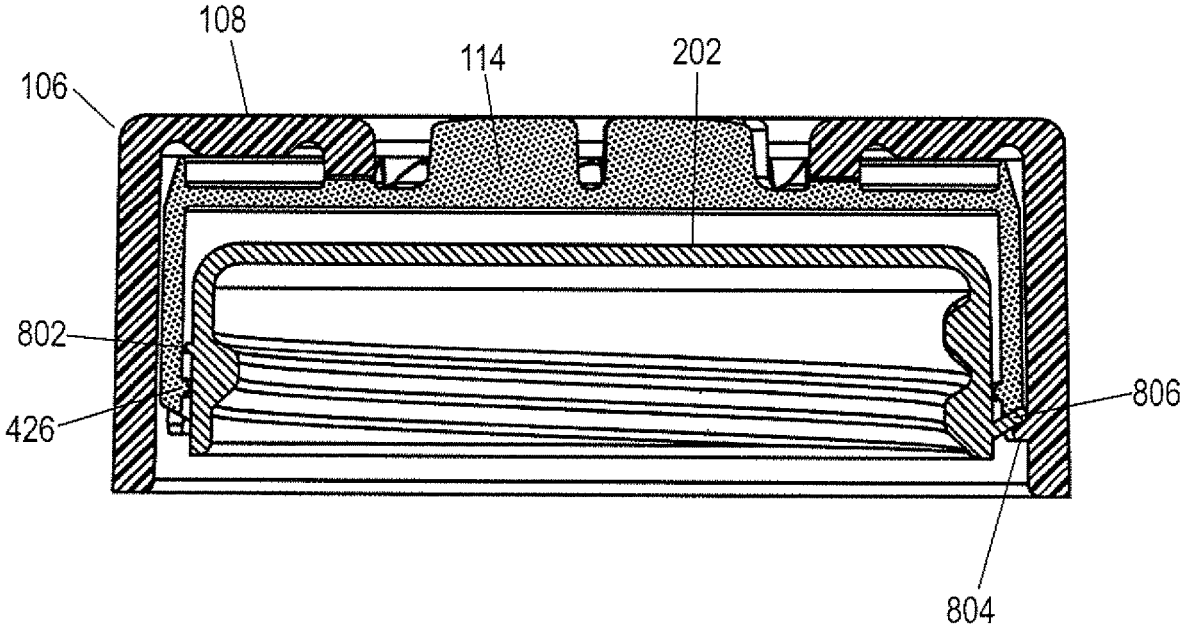
FIG. 8 shows a section view of the cap assembly in FIG. 1 and the relative positions of components when the cap assembly is not threaded to the bottle.

FIG. 8 shows a section view of the cap assembly 106 in FIGS. 1 and 7 and the relative positions of components. Inner cap 202 is shown rotatably mounted within schedule display 114 by inner cap protrusions, such as protrusion 802 and schedule display annular retainer 426. The inner cap and schedule display assembly are mounted within cap 108 by cap lugs and inner cap bosses, such as cap lug 804 and inner cap boss 806.

When the cap assembly is applied to the bottle and rotated to close the bottle, the cap threads engage with the bottle threads and, in a screw-like fashion, the cap assembly is drawn downward over the neck of the bottle. The inner cap sealing surface (504 in FIG. 5) reaches and is pressed onto the bottle lip (226 in FIG. 2), creating an airtight seal. Contact between the inner cap and the bottle lip creates friction, halting rotation of the inner cap. The schedule display is also impeded from rotating with the cap due to contact of biasing feature engaging sides (424 in FIG. 4B) with inner cap boss leading edges (510 in FIG. 5). As the cap rotates around the schedule display cap aperture (116 in FIG. 1) rotates around schedule display indicia (414 in FIG. 4) from one sequential indicium to the next. At the start of each dispensing cycle, the cap ratchet-wheel (314 in FIG. 3) is fully meshed with the schedule-display ratchet-wheel (402 in FIG. 4). As the cap rotates around the schedule the cap ratchet wheel rotates around the schedule display ratchet wheel in the disengaged direction the angular distance between two adjacent teeth. Advancing the cap aperture to a next sequential indication advances the cap ratchet-wheel teeth from one fully engaged and meshed position to a next fully engaged and meshed position. When the ratchet wheel teeth tips pass each they make an audible click and provide haptic feedback providing confirmation that the cap has made an indication. Cap lugs (302-305 in FIG. 3) travel along the sliding sides of the schedule display biasing features (422 in FIG. 4B) and then along the lower sliding sides of the inner cap (514 in FIG. 5) until they reach the stop portion of said bosses (516 in FIG. 5) halting rotation of the cap relative to the schedule display and inner cap. The cap aperture is now centered over the next sequential indicium. If a user continues to rotate the cap further the lug blunt ends (308 in FIG. 3) drive the stop portions of the inner cap bosses (516 in FIG. 5) such that the inner cap and schedule display rotate in cooperation with the cap and the aperture remains centered over the next sequential indicia. Therefore, when affixing the cap assembly the cap aperture cannot rotate past the next sequential indicium. During the process of affixing the cap and making and indication the top of the cap (110 in FIG. 1) and the top of the schedule display (212 in FIG. 2) flex to allow the ratchet wheels to slip past each other. However, once and indication is made the components settle into a resting position without flexing, stretching, or compression to prevent possible distortion.

The cap assembly provides a mechanism for child-resistance. When a user rotates the cap in the direction opposite from the direction in which the cap assembly is screwed onto the bottle for the purpose of removing it, the cap ratchet-wheel teeth engage the schedule-display ratchet-wheel teeth to compel the schedule display to rotate in cooperation with the cap such that the cap aperture remains centered over the intended indicium. Friction between the inner cap and bottle from tightening the cap when it was affixed holds the inner cap stationary. The schedule display biasing features slide along the inner cap boss upper sliding surfaces (512 in FIG. 5). The cap lugs travel along the boss lower sliding surfaces (514 in FIG. 5) until the lugs tapered ends (306 in FIG. 3) reach the sliding ends (518 in FIG. 5) of the next sequential inner cap boss. As a user continues to rotate the tapered ends of the lugs slide up and over the boss sliding ends such that the cap and schedule display rotate around the inner cap. Each time the lugs reach the next sequential set of bosses they slide over them. The outer cap and schedule display therefore rotate indefinitely around the inner cap which remains screwed onto and affixed to the bottle thus providing child-resistance. To remove the cap assembly from the bottle a user applies downward force on the cap and simultaneously rotates it around the bottle. The schedule display rotates with the cap. Cap lugs slide along the underneath of the inner cap bosses until the tapered ends reach the sliding ends of the bosses. However, with downward force applied the lugs do not slip over the bosses but rather compel the bosses, and thus the inner cap, to rotate with the cap and schedule display and the inner cap internal thread (502 in FIG. 5) unscrews from the bottle thread (224 in FIG. 2). The cap assembly is removed from the bottle. Each cap lug and each inner cap boss is again nested under a schedule display biasing feature. The cap assembly and is ready for the next indicating cycle and the process can be repeated indefinitely.

FIGS. 9A-L provide unwrapped views of the cap, schedule display, inner cap, and bottle components of the CRDC that illustrate step-by-step interaction of these components as the cap is screwed onto, and removed from, the CRDC bottle. In FIGS. 6A-L, interactions between five different sets of features are shown, next identified with respect to FIG. 9A. A first set of features 902 includes: (1) the cap ratchet wheel (314 in FIG. 3); and (2) the schedule-display ratchet wheel (402 in FIG. 4A). A second set of features 904 includes: (1) the cap aperture (116 in FIG. 1) in the cap rim; and (2) the schedule-display indicia 912-915. A third set of features includes: (1) the schedule display biasing features (416 in FIG. 4A); (2) cap lugs 916-917; and (3) inner cap bosses 918-919. A fourth set of features 908 includes: (1) the inner cap sealing surface (504 in FIG. 5); and (2) the bottle lip (226 in FIG. 2). A fifth set of features 910 includes: (1) inner cap threading (502 in FIG. 5); and (2) the bottle threading (224 in FIG. 2). In FIGS. 9A-L, different types of crosshatching are used to distinguish the components and/or features in each set. Also, in FIGS. 9B-9L, small arrows, such as small arrow 920 (see FIG. 9B), are used to indicate relative motion of one or more features with respect to other features.

Figure 9A:
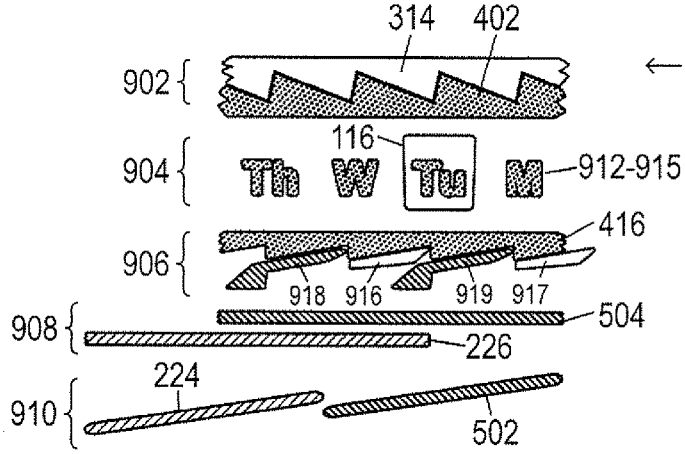
FIGS. 9A-L provide unwrapped views of the cap, schedule-display, inner cap, and bottle components of the CRDC that illustrate step-by-step interaction of these components as the cap is screwed onto, and removed from, the CRDC bottle.

FIGS. 9A-F illustrate the process of affixing the cap assembly to the bottle and the interaction of the various features and components during this process. As shown in FIG. 9A, prior to screwing the cap assembly onto the bottle, the cap ratchet wheel and schedule display ratchet wheel are meshed together 902, fixing the position of the schedule display with respect to the cap. The cap assembly is not affixed to the bottle. Inner cap sealing surface is above the bottle lip 908 and inner cap thread is not engaged with bottle thread 910.

When the cap assembly is placed onto the bottle and rotated, the cap threading starts traveling along the bottle threading 910. As shown in FIG. 9B, when the cap assembly is rotated in a clockwise direction, the schedule-display sealing ring comes into contact with the bottle lip 908.

Figure 9D:
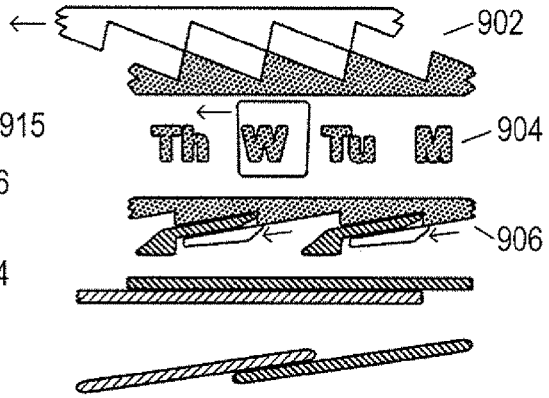
Figure 9B:
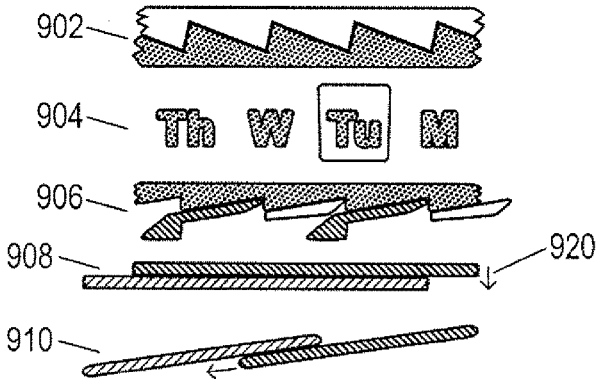
Figure 9E:
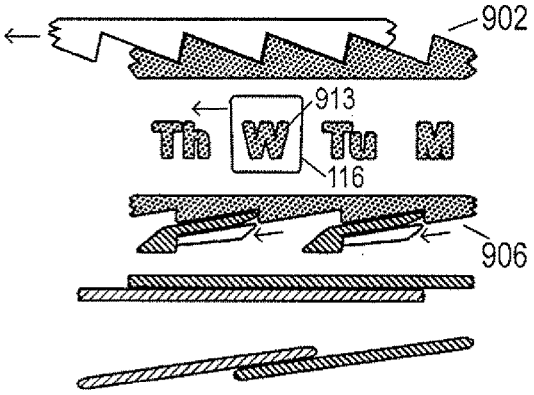
Figure 9C:
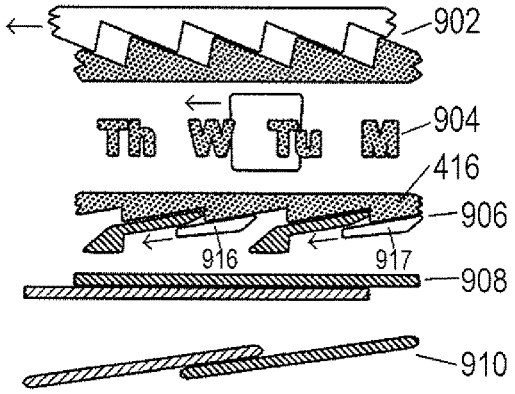

As shown in FIG. 9C, as the cap continues to be rotated, the engagement between the inner cap sealing surface and the bottle lip 908 hinders the inner cap from rotating further. Engagement of schedule display biasing features with the inner cap bosses 906 prevents further rotation of the schedule display with respect to the inner cap and bottle. Also shown in FIG. 9C the cap ratchet wheel advances relative to the schedule display ratchet wheel 902, the cap aperture advances relative to schedule display indicia 904, cap lugs advance relative to schedule display biasing features and inner cap bosses 906.

FIG. 9D shows the cap continuing to advance relative to the other cap features and bottle. The cap ratchet wheel advances relative to the schedule display ratchet wheel 902, the cap aperture advances relative to schedule display indicia 904, cap lugs advance relative to schedule display biasing features and inner cap bosses 906.

The indication-advancement cycle started in FIG. 9A is complete in FIG. 9E. The cap ratchet wheel has advanced to the next tooth relative to schedule display ratchet wheel and is re-meshed 902. When the ratchet wheel teeth tips pass each they make an audible click and provide haptic feedback providing confirmation that the cap has made an indication. Cap aperture 116 has advanced to the next sequential indicium 915. The cap lugs have reached the stop portion of the inner cap bosses 906. Screwing the cap assembly onto the bottle results in advancement of the displayed schedule indication by one and only one indicium along the sequence of schedule indicia disposed along the schedule-display-rim surface.

Figure 9F:
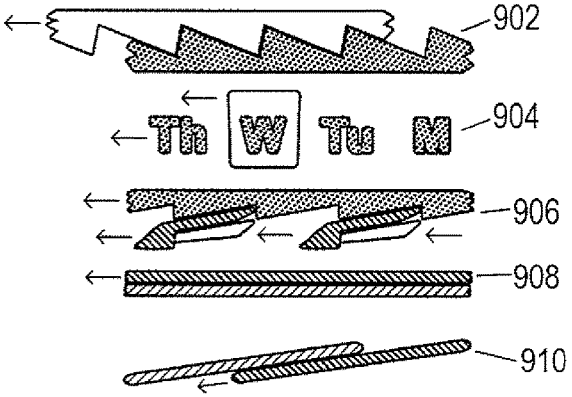

In FIG. 9F a user continues to tighten the cap assembly to the bottle after it has made an indication. Cap lugs drive the inner cap bosses so that entire cap assembly rotates in unison 906. The cap and schedule display ratchet wheels stay meshed 902, and the cap aperture remains centered over the intended indicium 904. The inner cap sealing surface rotates relative to the bottle lip 908 and the inner cap thread travels along the bottle thread 910.

Note that, as shown by the configuration of feature sets in FIG. 9A and the sequence of steps in FIGS. 9A-D, when an attempt is made, but fails, to properly thread and screw the cap onto the bottle, the cap assembly will not make an indication thus avoiding error. When the cap assembly is removed from the bottle the cap and schedule display ratchet wheels are fully meshed. Additionally, the schedule display biasing features are engaged with the cap lugs. It is only after the cap is properly threaded and the inner cap sealing surface contacts the bottle lip that the cap will rotate around the schedule display. Therefore, the display advances to a next indication only when the cap is successfully screwed onto to the bottle. Further, the cap lugs and biasing features are designed with a shallow pitch such friction between the inner cap and bottle overcomes friction between the cap and schedule display with minimal force. The cap and schedule display ratchet wheels are positioned closer to the rotational center of the cap providing mechanical advantage over them. As such, making an indication involves application of less force than needed to tighten the cap onto the bottle. Thus, the indication is made before a user stops tightening the cap on to the bottle ensuring that an indication is always made. There is no motion and no extra steps needed to advance the indication other than screwing the cap onto the bottle. The cap provides both an audible click and haptic feedback to confirm that an indication is made.

Note that, in the CRDC implementation shown in FIGS. 1-9, the engaging sides of the cap and schedule-display ratchet teeth are not perpendicular to their bases, but are instead slightly slanted away from the tapered sides so that the inside angles between the engaging sides and the bases are acute. This slant reduces an advancement angle over which a cap ratchet tooth needs to advance in order to engage with a next schedule-display ratchet tooth, so that the advancement angle is less than the internal angle subtended by a ratchet tooth. As a result, the number of cap and schedule-display ratchet teeth can be equal to the number of schedule indicia. Furthermore, this slant also allows a cap ratchet tooth to reach a next schedule-display ratchet tooth slightly before the cap aperture is centered over a next schedule indication and before the blunt ends of the cap lugs collide with the stop portions of the inner cap bosses. Alternatively, to achieve the same effect, the rotational positions of the cap ratchet teeth may be adjusted so that they reach the next sequential schedule-display ratchet teeth before the cap aperture is centered over a next schedule indication. As a result, the example CRDC implementation advances by exactly one indication each time the cap assembly is screwed onto the bottle despite a range of user and manufacturing variations as well as potential wear from use. The difference in timing between the cap ratchet teeth snapping into place with cap lugs reaching the boss stop portions sufficiently slight so that it is generally imperceptible to users.

Figure 9G:
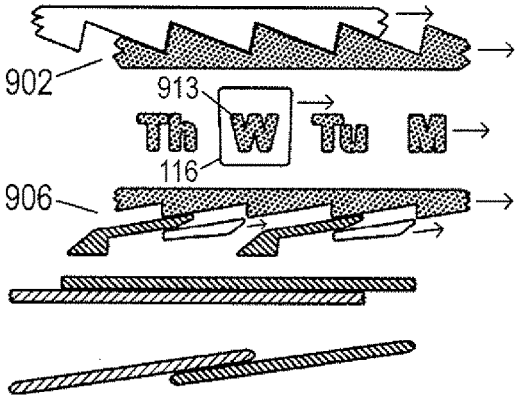
Figure 9J:
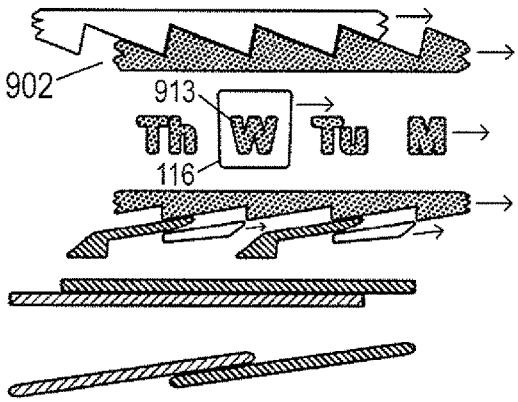
Figure 9H:
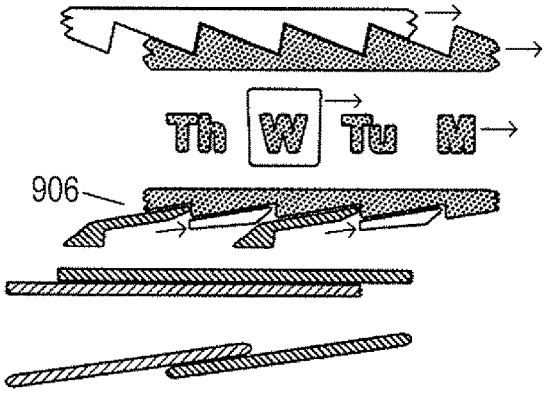
Figure 9K:
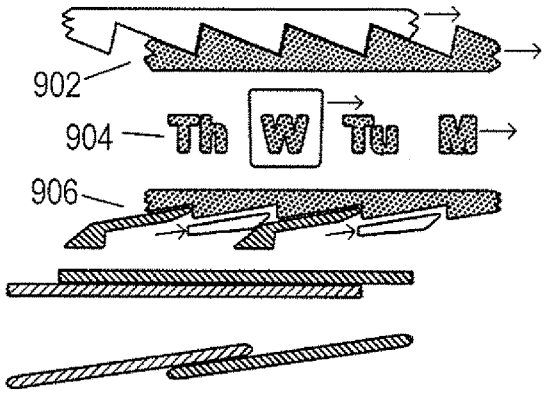
Figure 9I:
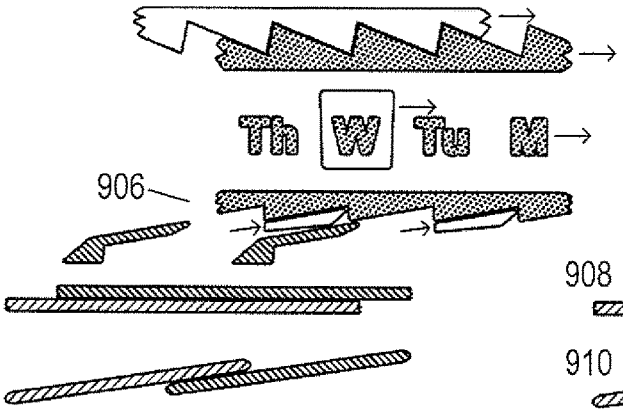
Figure 9L:
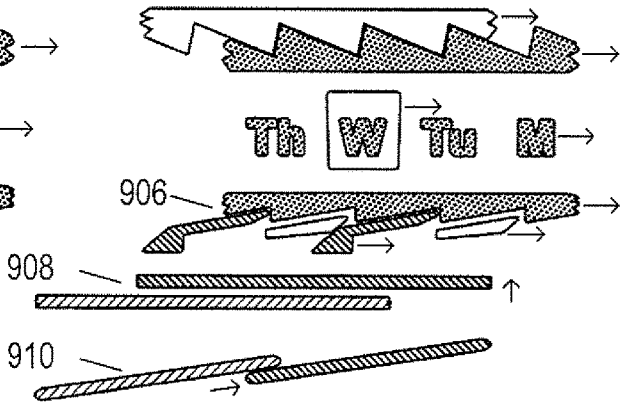

FIGS. 9G-I show an attempted removal of the cap assembly from the bottle whereby a user does not overcome the child-resistance feature. FIGS. 9J-L show the successful removal of the cap assembly from the bottle. In FIG. 9G a user rotates the cap for the purpose of removal. The cap ratchet wheel engages the schedule display ratchet wheel compelling the schedule display to rotate with the cap 902. As the schedule display rotates in cooperation with the cap aperture 116 remains centered over indicium 913. Friction between the inner cap and bottle created when the cap was affixed holds the inner cap from rotating with the cap and schedule display. The cap lugs slide out along the lower sliding surface of the inner cap bosses 906.

In FIG. 9H the cap lugs have cleared the inner cap bosses and reached the sliding end of the next sequential inner cap bosses 906. In FIG. 9I as a user continues to rotate the cap the tapered ends of the lugs slide up and over the boss sliding ends 906. The cap and schedule display continue to rotate around inner cap and bottle without engaging the inner cap to unthread it from the bottle. Each time the lugs reach the next sequential bosses they again slide over then. The outer cap and schedule display therefore rotate indefinitely around the inner cap which remains affixed to the bottle thus providing child-resistance.

In FIGS. 9J-L a user applies downward force while rotating the cap for removal and, in contrast to FIGS. 9G-I, overcomes the child-resistance feature and removes the cap from the bottle. In FIGS. 9J-K the movement of the various components is much like that in FIGS. 9G-H. The cap ratchet wheel engages the schedule display ratchet wheel compelling the schedule display to rotate in cooperation with the cap 902 and the cap aperture 116 remains centered over indicium 913. In FIG. 9K the cap lugs clear the lower sliding surface of the inner cap bosses and reach the sliding ends of the next sequential bosses. However, as shown in FIG. 9L, with pressure applied to the cap the cap lugs do not slide over the cap bosses 906. Instead, they push the bosses forward, compelling the inner cap to overcome friction relative to the bottle and rotate in cooperation with the outer cap and schedule display. The inner cap thread unscrews from the bottle thread 910 for removal and the cap assembly lifts away from the bottle lip 908. As also shown in FIG. 9A, the cap lugs and inner cap bosses are once again settled within the schedule display biasing features 906 and the cap assembly is ready for the next cycle. The process can be repeated indefinitely.

In the example CRDC implementation shown in FIGS. 1-9, the cap ratchet teeth and schedule-display ratchet teeth form a ratchet in the clockwise direction. This function can also be provided by a variety of mechanisms connecting the top of the schedule display to the bottom of the cap, including, prongs, pawls, or a variety of different types of projections, notches, or grooves on one component and a complementary mechanism on the other. A ratchet means may alternatively be established in other locations between the outside of the schedule display and the inside of the cap. For example, a ratchet can be located around the side wall of the schedule display and the inside of the side wall of the cap. Furthermore, the schedule-display ratcheting features can have a variety of shapes that provide a side, on each schedule-display ratcheting feature, to engage cap ratcheting features, when rotated in one direction, and a side along which the cap ratcheting features can slide, when rotated in the other direction.

The display surface of schedule display of the CRDC implementation shown in FIGS. 1-9 provides sufficient space for large-characters and large-symbol indication within schedule indications. In alternative CRDC implementations, the schedule indications are instead located on the disk-shaped surface of the schedule display and the cap aperture is located on the top face of the cap. In yet other CRDC implementations, the cap aperture is replaced with an indicator or arrow which designates or points to an individual schedule indication in each allowed position following initial positioning or indication advancement. In certain implementations, the placement of the indicator and schedule indications is swapped so that the schedule indications are on the cap and the indicator is on the schedule display.

Schedule indications can be printed, imprinted, embossed, debossed, or adhered. A method utilized for manufacturing the currently described implementation involves a two-shot molding in which a first color of plastic is injected into the schedule-display mold to fill either the schedule indication or the body of the schedule display. A portion of the mold is removed and a second color of plastic is injected so that the schedule indications consist of a different color plastic than the body.

The grips on the schedule display used to manually set the cap are accessible through a hole in the top of the cap rather than from underneath the inner cap such that the inner cap has a smooth sealing surface for placement of an optional induction heated seal. However, the grips may also be located on the inside of the inner cap whereby rotating the inner cap would drive rotation of the schedule display. Further, the grips can be located on the inside of the schedule display, accessible through a hole in the inner cap.

The numbers of ratchet teeth, biasing features, lugs, and bosses depends upon the number of schedule indicia. The number of ratchet teeth is an integer multiple of the number of indicia such that at the conclusion of each indication cycle the ratchet wheels are aligned to re-mesh. In the implementation shown, there is one ratchet tooth per indicia such that there is only one click and one haptic feedback event per indication. A one-to-one ratio of teeth to indicia allows for larger teeth better suited for the accuracy level of current plastic molding techniques. The number of biasing features equals the number of indicia. The numbers of cap lugs and inner cap bosses are equal and are a divisor of the number of indicia and biasing features such that the number of indicia are an integer multiple of the number of lugs or bosses. In the CRDC implementation shown there are 14 indicia. This enables printing both the most common a one-a-day and two-a-day dosing schedules. As shown for a one-a-day dose schedule, there are two consecutive cycles of each day of the week. For a two-a-day dose schedule the indicia print could include both an AM and PM for each day of the week, for example, M AM, M PM, etc. For a three-a-day schedule an implementation may have 21 indicia (1, 2, 3 for each day), 21 biasing features, and seven cap lugs and inner cap bosses. CRDC implementations are effectively calibrated to any number of schedule elements that are a multiple of seven days of the week and can therefore conform to the most common prescription schedules, although the number of schedule elements may be other than multiples of seven.

CRDC implementations function automatically and accurately, preventing human error. CRDC implementations provide a means for manual adjustment to a correct indication. This is particularly helpful for presetting the indicator to a correct day and time of the first dosage. CRDC implementations include a commonly-accepted form of childproofing, are airtight (moisture impermeable), and do not require a non-standard method of applying the cap to the bottle. CRDC implementations function without overly stressing any of the components, namely the cap, the schedule display, the inner cap, and the bottle, facilitating the reduction and/or elimination of wear. Therefore, CRDC implementations achieve a higher level of durability for safe dispensing of medications. The displayed schedule display is not advanced unless the cap is successfully screwed onto a bottle, eliminating potential human error. Furthermore, the schedule display advances one schedule element at a time and, at the end of each dispensing cycle, is automatically realigned for a next cycle.

Each of the components of the example CRDC implementation can be rapidly mass-manufactured with simple molds. The cap assembly of the example CRDC implementation includes only three separate components and can be made of the same materials from which common, commercially-available pill bottles are manufactured. Additionally, the indicating mechanism utilized by the current CRDC implementations is designed to function properly despite potential variations in manufacturing accuracy. Assembly of the CRDC cap is simple and can be easily automated. The inner cap is pressed into the schedule display and the pair are pressed into the cap. The cap assembly of CRDC implementation shown in FIGS. 1-9 is compatible with commercially available bottles with standardized neck sizes and finishes.

Although the current disclosure has been described in terms of a particular CRDC implementation, it is not intended that the current disclosure be limited to this CRDC implementations. Modifications will be apparent to those skilled in the art. For example, as mentioned above, the number of indicia, biasing features, ratchet teeth, lugs, or bosses can be varied, in alternative CRDC implementations, in order to provide different numbers of schedule elements. In alternative CRDC implementations, different biasing mechanisms may be used with same or different shapes or locations. In alternative CRDC implementations, an alternative mechanism or feature for rotating the schedule display with respect to the cap in order to set an initial schedule display element may be used instead of the grips discussed above with reference to FIG. 7. In certain CRDC implementations, features complementary to an initial-schedule-element setting tool can be used to ensure that the schedule is set by a pharmacist or other healthcare provider. As discussed above, the schedule elements contain various different types of information related to times, days of the week, dates, and other such characteristics that specify when a next dose is to be administered. The schedule elements may be molded, embossed, printed, or otherwise placed onto the exterior wall of the schedule-display rim. The dimensions and shapes of each of the component features may vary with varying CRDC implementations provided that they interoperate together as described above. The cap, schedule display, inner cap, and bottle may be manufactured from any of many well-known polymeric materials, and can have essentially arbitrary colors, transparencies, rigidity and flexibility, and other such characteristics and parameters. The bottle and cap may contain additional features, including additional information displays, features for facilitating attachment of additional information by pharmacies and pharmacists, and other features.

It is appreciated that the previous description of the disclosed CRDC implementations is provided to enable any person skilled in the art to make or use the present disclosure. Various modifications to these CRDC implementations will be readily apparent to those skilled in the art, and the generic principles defined herein may be applied to other CRDC implementations without departing from the spirit or scope of the disclosure. Thus, the present disclosure is not intended to be limited to the CRDC implementations shown herein but is to be accorded the widest scope consistent with the principles and novel features disclosed herein.

The invention claimed is:

1. A container with a dispensing schedule, the container consisting of:

a conventional bottle with a threaded neck; and a three-piece cap assembly that includes a cap with a display aperture, a schedule display mounted within the cap that includes a circularly ordered set of indications, interoperates with the cap and bottle to advance the display aperture to a next indication of the schedule display when the cap assembly is screwed onto the bottle, and interoperates with the cap to prevent indication advancement when the cap assembly is unscrewed and removed from the bottle, and an inner cap;

wherein the cap engages the schedule display and inner cap when the cap is pushed down and rotated.

2. The container with a dispensing schedule of claim 1 wherein components of the cap assembly block the cap from rotating further than a single indication relative to the schedule display when the cap assembly is screwed onto the bottle.

3. The container with a dispensing schedule of claim 1 wherein the inner cap includes a threaded inner surface complementary to the threaded neck of the bottle.

4. The container with a dispensing schedule of claim 3 wherein the cap, the schedule display, inner cap, and bottle are each single piece components.

5. The container with a dispensing schedule of claim 1 wherein the schedule display includes one or more manual-manipulation features that allow for manual indication advancement.

6. The container with a dispensing schedule of claim 5 wherein the manual manipulation features are accessible through a hole in the top of the cap.

7. The container with a dispensing schedule of claim 1 wherein the threaded neck of the bottle has one or more threads, each thread with a thread pitch selected from among:

a thread pitch of less than 2 degrees;

a thread pitch of less than 2.5 degrees;

a thread pitch of less than 5 degrees; and a thread pitch of less than 10 degrees.

8. The container with a dispensing schedule of claim 1 wherein the number of indications is equal to 7 multiplied by n, where n is an integer equal to, or greater than, 1.

9. The container with a dispensing schedule of claim 1 wherein the indication-display aperture is located at position of the cap selected from among:

a rim of the cap; and a top of the cap.

10. The container of a dispensing schedule of claim 3 wherein the schedule display includes biasing features.

11. The container with a dispensing schedule of claim 10 wherein the inner cap includes bosses that interact with biasing features on the schedule display to block rotation of the schedule display relative to the bottle in a first direction.

12. The container with a dispensing schedule of claim 3 wherein the cap includes lugs around the insider perimeter of its skirt.

13. The container with a dispensing schedule of claim 12 wherein the inner cap includes bosses that the cap lugs engage when the cap is pushed downward while rotated for the purpose of unthreading the inner cap from the bottle.

14. The container with a dispensing schedule of claim 1 wherein the cap and schedule display include complimentary ratchet wheels whereby the ratchet wheels disengage when the cap assembly is affixed to the bottle enabling the cap to rotate around the schedule display to make an indication and engage when the cap is rotated in the opposite direction for the purpose of removal from the bottle so that the schedule display rotates in cooperation with the cap and the display aperture remains centered over an indication.

15. The container with a dispensing schedule of claim 1 wherein, when the cap assembly is screwed onto the bottle, the container with a dispensing schedule produces an audible click as the display aperture is advanced to a next indication of the schedule display schedule display.

16. The container with a dispensing schedule of claim 1 wherein, when the cap assembly is screwed onto the bottle, the container with a dispensing schedule produces haptic feedback as the display aperture is advanced to a next indication of the schedule display schedule display.

17. A container with a dispensing schedule, the container consisting of:

a conventional bottle with a threaded neck; and a cap assembly that includes a cap with a display aperture, and an inner cap with a thread for mounting to the bottle, and a schedule display mounted within the cap assembly that includes a circularly ordered set of indications, interoperates with the cap, inner cap, and bottle to advance the display aperture to a next indication of the schedule display when the cap assembly is screwed onto the bottle, and interoperates with the cap to prevent indication advancement when the cap assembly is unscrewed and removed from the bottle, wherein the cap engages the schedule display and inner cap for rotation and removal when it is pushed down and rotated to provide child-resistance.

18. The container with a dispensing schedule of claim 17 wherein the display aperture advances only one indication when the cap is affixed to the bottle.

19. The container with a dispensing schedule of claim 18 wherein the cap advances relative to the schedule display only when the cap is correctly affixed to the bottle or manually advanced by manual manipulation features accessible on the exterior of the cap assembly.

* * * * *